US012577783B1

(12) United States Patent
Bonerb

(10) Patent No.: US 12,577,783 B1
(45) Date of Patent: Mar. 17, 2026

(54) SELF CLEANING GUTTER AND ROOF SYSTEM

(71) Applicant: Tim Bonerb, Rye Beach, NH (US)

(72) Inventor: Tim Bonerb, Rye Beach, NH (US)

( * ) Notice: Subject to any disclaimer, the term of this patent is extended or adjusted under 35 U.S.C. 154(b) by 0 days.

(21) Appl. No.: 19/065,283

(22) Filed: Feb. 27, 2025

Related U.S. Application Data

(60) Provisional application No. 63/728,430, filed on Dec. 5, 2024.

(51) Int. Cl.
*E04D 13/064* (2006.01)
*E04D 13/076* (2006.01)

(52) U.S. Cl.
CPC ..... *E04D 13/064* (2013.01); *E04D 13/0762* (2013.01)

(58) Field of Classification Search
CPC . E04D 13/076; E04D 13/064; E04D 13/0765; E04D 13/0762
See application file for complete search history.

(56) References Cited

U.S. PATENT DOCUMENTS

| | | | | |
|---|---|---|---|---|
| 5,746,027 | A | 5/1998 | Bonerb | |
| 5,989,357 | A * | 11/1999 | Vilhauer, Jr. | E04D 13/076 52/12 |
| 6,668,491 | B1 | 12/2003 | Bonerb | |
| 2019/0017274 | A1 * | 1/2019 | Song | G01W 1/02 |

FOREIGN PATENT DOCUMENTS

| | | | | |
|---|---|---|---|---|
| CA | 2328678 | A1 * | 3/2001 | E04D 13/0762 |
| DE | 20304221 | U1 * | 8/2004 | E04D 13/0765 |
| EP | 0903449 | A2 * | 3/1999 | E04D 13/076 |
| WO | WO-9839534 | A2 * | 9/1998 | E04D 13/076 |

* cited by examiner

*Primary Examiner* — Babajide A Demuren
(74) *Attorney, Agent, or Firm* — Hayes Soloway P.C.

(57) ABSTRACT

The concept includes improvements in the method and apparatus for removing ice, snow, leaves and other debris from roofs and gutters using a flexible cover attached over the roof that moves via the operation of one or more inflatable membranes positioned under the gutter cover. The concept also uses a gutter frame secured on the surface of a roof which acts as a brake to keep snow and ice from suddenly and unexpectedly sliding off the roof which provides a high level of safety.

20 Claims, 16 Drawing Sheets

SELF CLEANING GUTTER AND ROOF SYSTEM

BACKGROUND

1.) Field of Invention

This invention relates to improvements for selling, distributing, installing and using a flexible sleeve arrangement for removing ice, snow, leaves and other debris from roofs and gutters on buildings.

2.) Description of Related Art

As many homeowners and businesses struggle with snow build up, ice dams and gutters that can easily fill with leaves and debris, the need for a single removal and protective system is desired. While many types of leaf and gutter guards have been available for years as well as the use of heat-tape and other types of heat panels configurations for melting ice dams have been available, there has not been a single system that can do it all with superior and simple operation.

SUMMARY

What is needed, therefore, is a gutter system that satisfies these needs. One object of the invention is to provide a method of removing ice and snow from a roof without using heat and melting.

Another object of the invention is to provide a covering that can move and shake to discharge snow, ice, leaves and other debris.

Another object of the invention is to hold snow and ice on a roof so that it doesn't slide or fall off and cause damage and/or personal injury.

Another object of the invention is to mount the blower under the covering, or in the attic, to hide the hoses and other air fittings.

Yet another object of the invention is to equip any style of roof surface such as shingled, metal, fiberglass, slate and or tile with the gutter frame and gutter cover assembly.

The above objects are achieved by a self-cleaning gutter system comprising: an L-shaped gutter frame comprising a gutter frame bottom thereby forming a gutter trough, the gutter frame bottom attachable parallel to a plane of an eave at a lowest end of a roof; an inflatable inflate membrane; an inflate membrane flap attachable at a first end to the roof uphill from the gutter frame and attached at a second end to the inflate membrane, thereby securing the inflate membrane uphill from the gutter frame; and a flexible gutter cover sized to be attached to under a shingle uphill from the inflate membrane flap, cover the inflate membrane in both a deflated state and an inflated state, and cover the gutter frame, whereby the inflate membrane in the deflated state causes gutter contents to be selectively retained on the roof by the gutter frame in the gutter trough, and the inflate membrane in the inflated state causes the gutter contents to be lifted upward and over an upper edge of the gutter frame and out of the gutter trough, thereby selectively removing the gutter contents from the roof. These and other benefits, features, and advantages will be made clearer in the accompanying description, claims, and drawings.

DETAILED DESCRIPTION OF THE INVENTION

Figure 1:
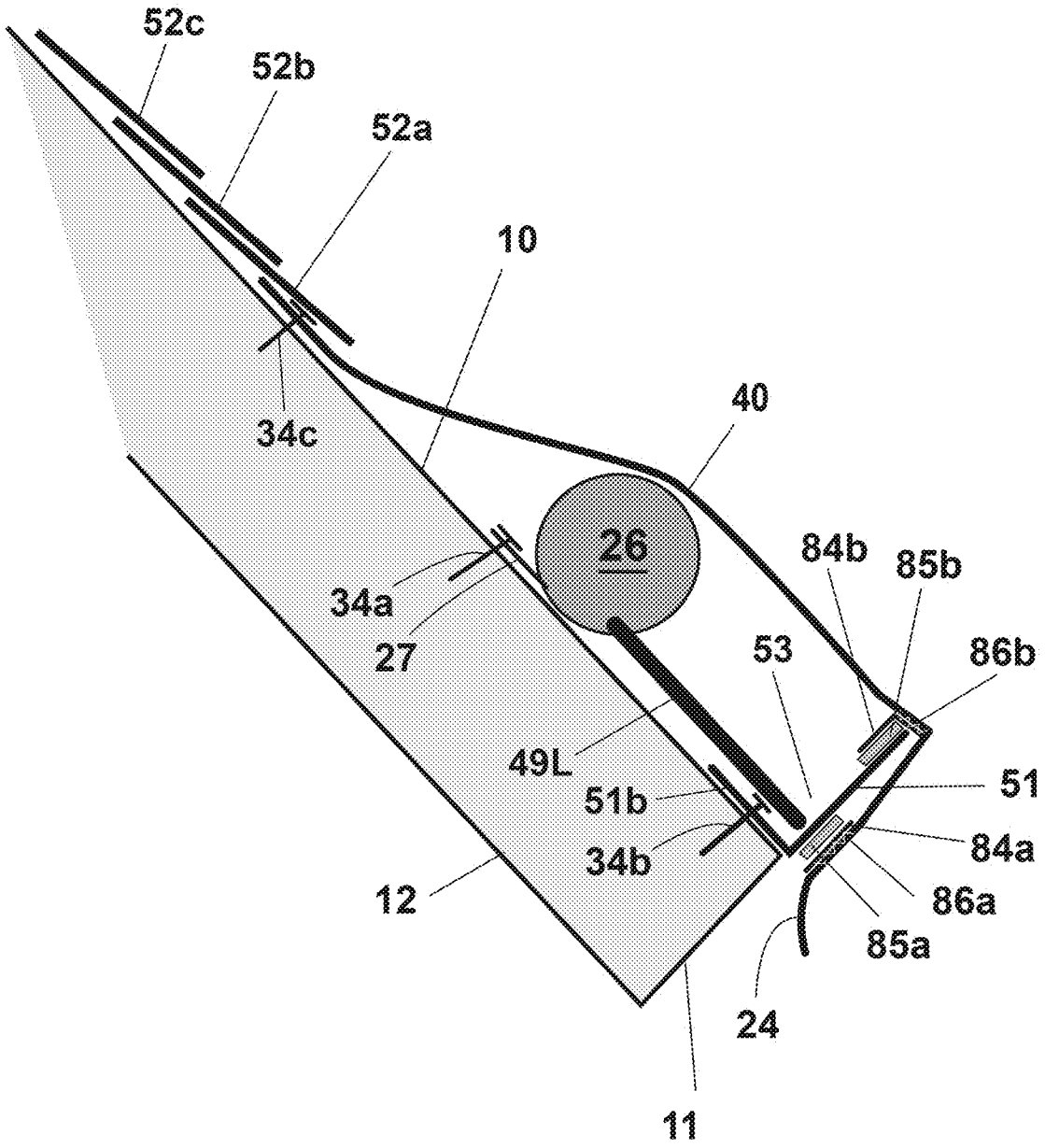
FIG. 1 is an end view of gutter cover fastened to gutter frame via hook & loop fastening strips with gutter frame securely fastened on top of roof with inflate membrane fully inflated. With inflate membrane fully inflated, gutter cover rises above the surface of the roof as well as the top end of gutter frame.

FIG. 1 is a side view of roof 10 equipped an L-shaped gutter frame 51 fastened to lower section of roof 10 directly above eave 11 via gutter frame bottom 51*b* and fastener 34*b*, such as nails or screws. As shown, a strip of 2 inchwide loop 85*a* is stapled, glued or otherwise fastened to the bottom outside gutter frame 51, (which can be made of wood, metal or plastic) as well as another strip of 2 inch wide loop 85*b* is fastened to the top section of gutter frame 51. Loop strip 85*a* will interface and fasten to strip of 2 inch wide hook 84*a* that is fastened to the inside surface of gutter cover 40 via stitch 86*a* as well as a 2 inch wide strip of hook 84*b* attached to the underside of gutter cover 40 via stitch 86*b*. Fasteners such as staples, nails, and screws can be used in addition the hook and loop fasteners to hold gutter cover 40 in place or without the use of hook and loop fastener. Also, notice bottom end of gutter cover 24 functions as a drip edge to keep water, snow and ice off of eave 11. It is important gutter cover 40 becomes taught as inflate membrane 26 is fully inflated so that any snow, ice, leaves, water and other debris on top of gutter cover in the area of gutter trough 53 rises above gutter frame 51 so it can flow off roof 10. With top end of gutter cover 40 fastened to roof 10 with fastener 34*c* under shingle 52*a* ensures gutter cover 40 will become taught as the bottom portion of gutter cover 40 is securely fastened to gutter frame 51 via hook 84 and loop 85 fasteners. As shown, inflate membrane 26 is equipped with inflate membrane flap 27 which is secured in the correct position and secured to roof 10 via fastener 34*a*. Low pressure air is supplied to inflate membrane 26 via blower line 49L and blower 21 (see FIG. 10). In addition to gutter cover 40 and inflate membrane 26 having the ability remove materials from roof 10 and to hold materials on roof 10 when inflate membrane 26 is deflated allowing gutter cover 40 to lay flat on roof 10, it also provides a high level of waterproofing to the bottom end of a roof 10. Gutter cover 40 with inflate membrane 26 and gutter frame 51 can also be installed on almost any type of roof, including metal, fiberglass, slate and tile roofs. When inflate membrane 26 is completely deflated and gutter cover 40 lays flat on roof 10, gutter frame 51 acts as a brake so snow and ice can't suddenly slide off roof 10 and create a hazardous situation.

Figure 2:
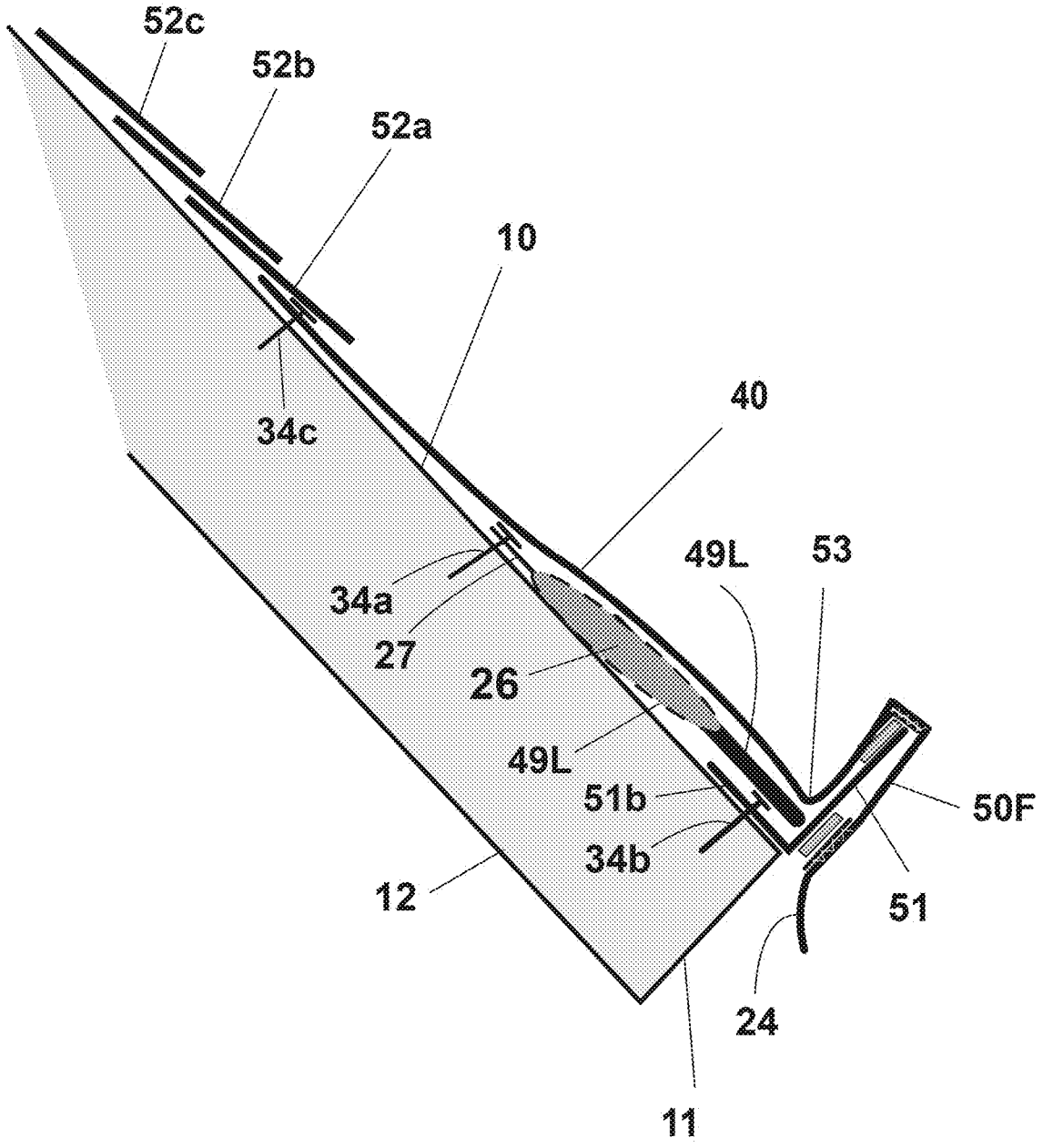
FIG. 2 is an view of gutter cover and gutter frame secured to the roof with inflate membrane fully deflated, allowing a gutter trough to function in handling water flowing down the roof.

FIG. 2 is an end view of a roof eave 11 equipped with gutter cover 41. Gutter cover 40 can be made of a PVC coated, woven polyester fabric from fabric weights between 22 oz. up to 40 ounce which is very strong and durable. Gutter cover 40 may also be provided in reflective colors such as white and silver to reflect the sun's rays and keep the roof and interior of a building much cooler. This benefit would be especially useful and valuable for larger commercial buildings that typically use darker colored roofs such as for dark colored shingles and metal roofs. The energy savings of using a white or silver roof compared to a dark shingled roof or colored metal roof can be significant. Many of these PVC coated woven fabrics have a tensile strength of above 600 lbs./inch. Top end of gutter cover 40 may be fastened to roof 10 under shingle 52*a* with a roof nail, staple, screw or other fastening means. Inflate membrane 26 is connected to roof 10 under gutter cover 40 via inflate membrane flap 27 with fastener 34*a*. In this configuration, gutter frame 51 may be a length of metal, fiberglass, rubber or vinyl angle. When you consider the design of a standard gutter system, which requires a lot of fasteners and brackets that is flimsy at best, and often requires seasonal maintenance and cleaning, the gutter cover 40 assembly is heavy duty as well as more attractive to the viewer with cover face 50F and drip edge 24 covering the eave 11. Because the gutter frame 51 can be sized higher, to accommodate more annual rainfall, downpours and storms, it can handle more water than a standard gutter. Also, because gutter cover 40 rises up over gutter frame 51, it is self-cleaning because it can quickly and easily dump anything in it (leaves, dirt, branches, twigs, ice and snow, etc.) off roof 10 and to the ground in seconds. Gutter cover 40 has a usable life of 20 to 25 years and is very, very strong and reliable, eliminating almost all maintenance issues as compared to a standard gutter system and leaf prevention components such as Leaf-Filter™ and Byers Leaf-Guard™. Also, gutter guards such as Leaf-Filter™ and Byers Leaf Guard™ and others do not remove and ice and snow from a roof, nor do they keep the bottom section of a roof and eave waterproofed. To keep gutter cover maintained and with its top surface in a slippery condition and to extend its life, compounds such as Armoral™ and other silicone sprays with RV protection can be applied. It is important to note that when snow 7 and ice buildup on gutter cover 40, all it takes is a slight motion of gutter cover 40 caused by the expansion action of inflate membrane expanding will cause ice and snow 7 to break free form it almost instantly, much like twisting a plastic ice tray to remove the ice cubes. As a safety feature, gutter frame 51 holds back the ice and snow 7 above it on roof 10 so it can't fall or slide off unexpectedly. It is only when gutter cover 40 lifts higher than gutter frame 51 when snow, ice, leaves and other debris can exit roof 11. Ice, snow, leave, and other debris 7 is collectively referred to as "gutter contents" in this description and in the claims. Gutter frame 51 and gutter cover 40 may be installed on shingled, metal, fiberglass, slate and/or tile covered roofs. Heat cable may be used under gutter cover 40 or on top of gutter cover 40 in trough 53 to help melt snow and ice so it can flow off roof 10 in the gutter trough 53.

Figure 3:
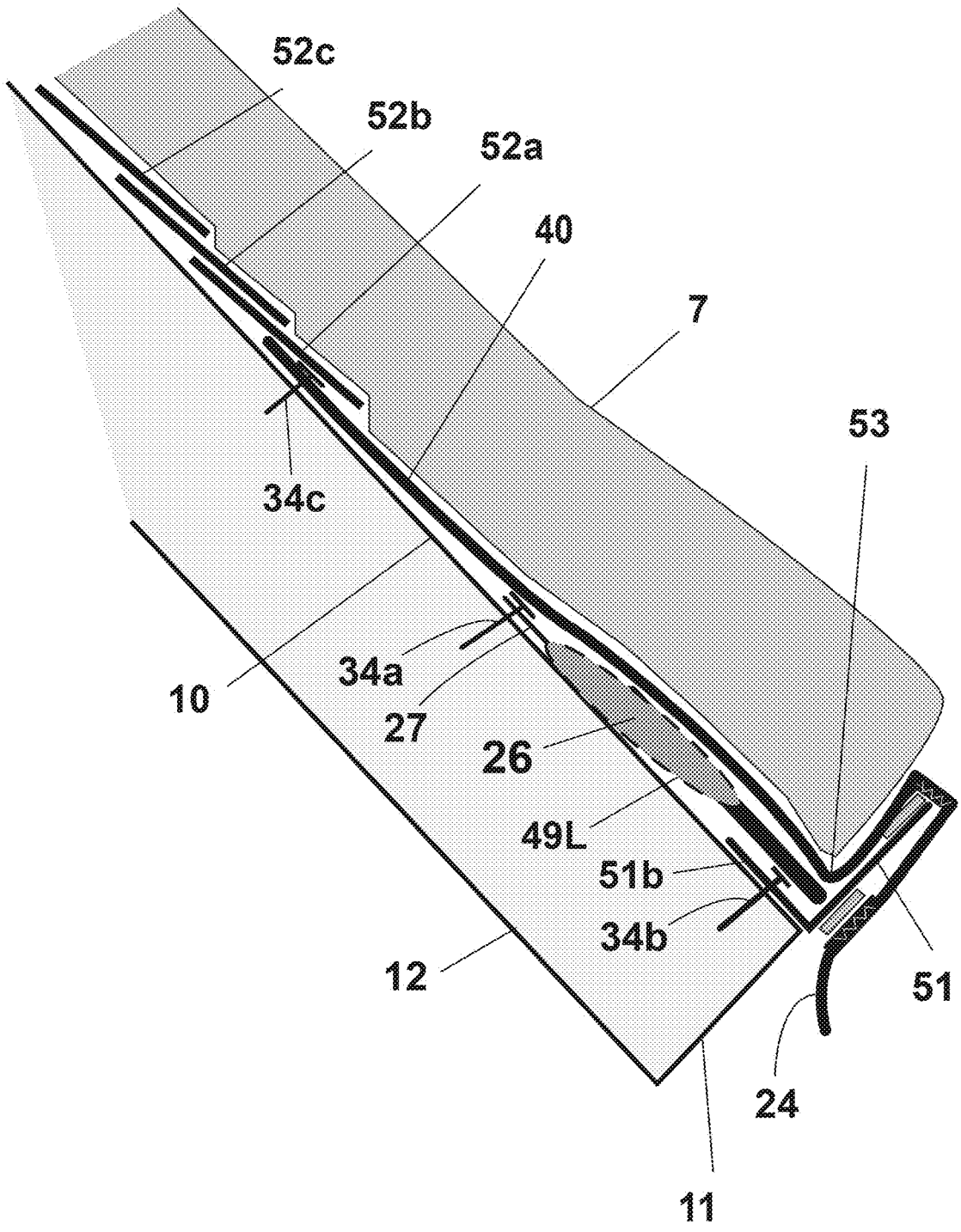
FIG. 3 is an end view of snow resting on gutter cover with inflate membrane deflated with gutter frame holding snow on roof. Gutter frame acts as a brake to prevent snow and ice from sliding off of the roof.
Figure 4:
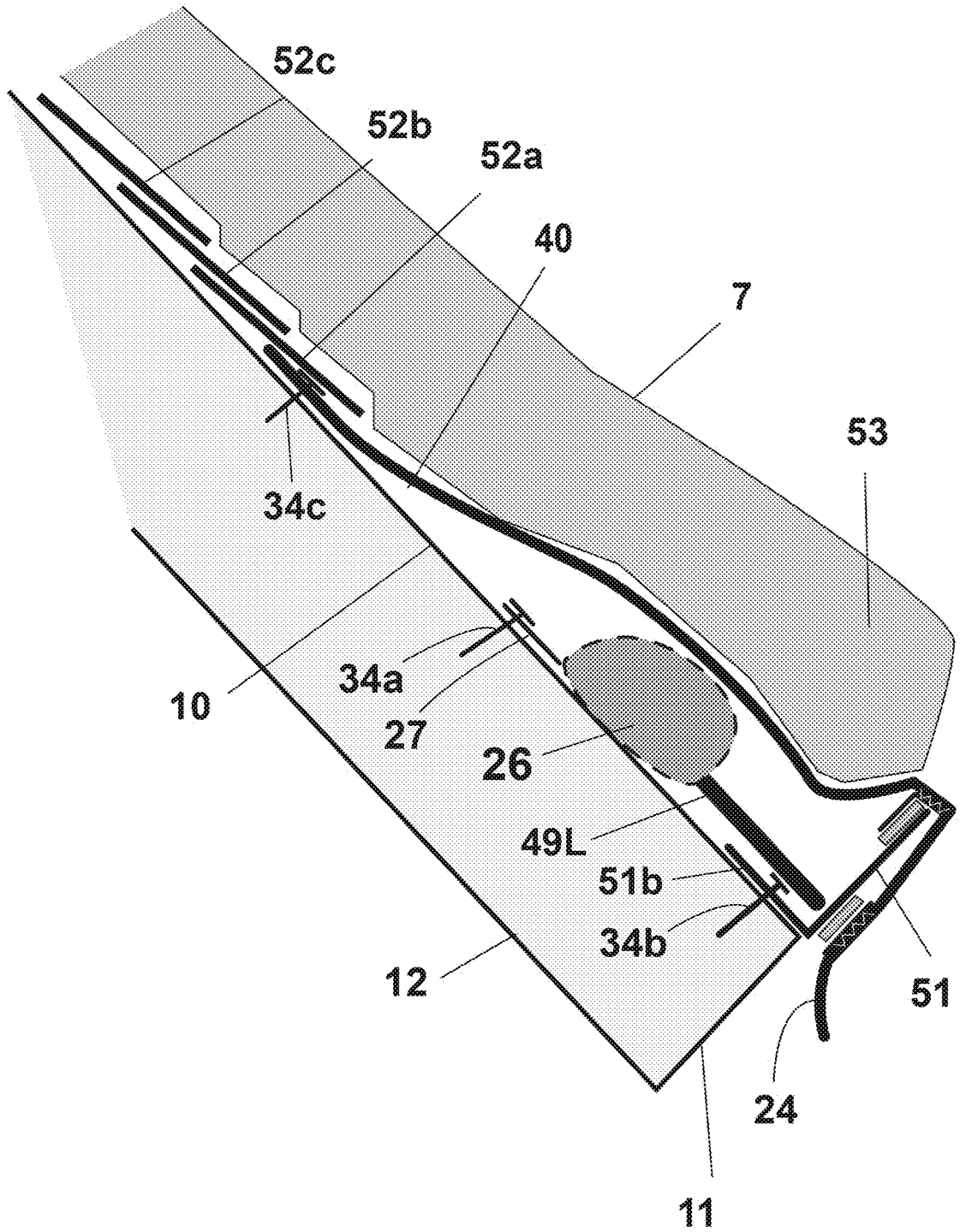
FIG. 4 is an end view of inflate membrane beginning to inflate under gutter cove which causes it to begin lifting upward from the roof while gutter frame continues to function as a partial brake to hold snow on roof.
Figure 5:
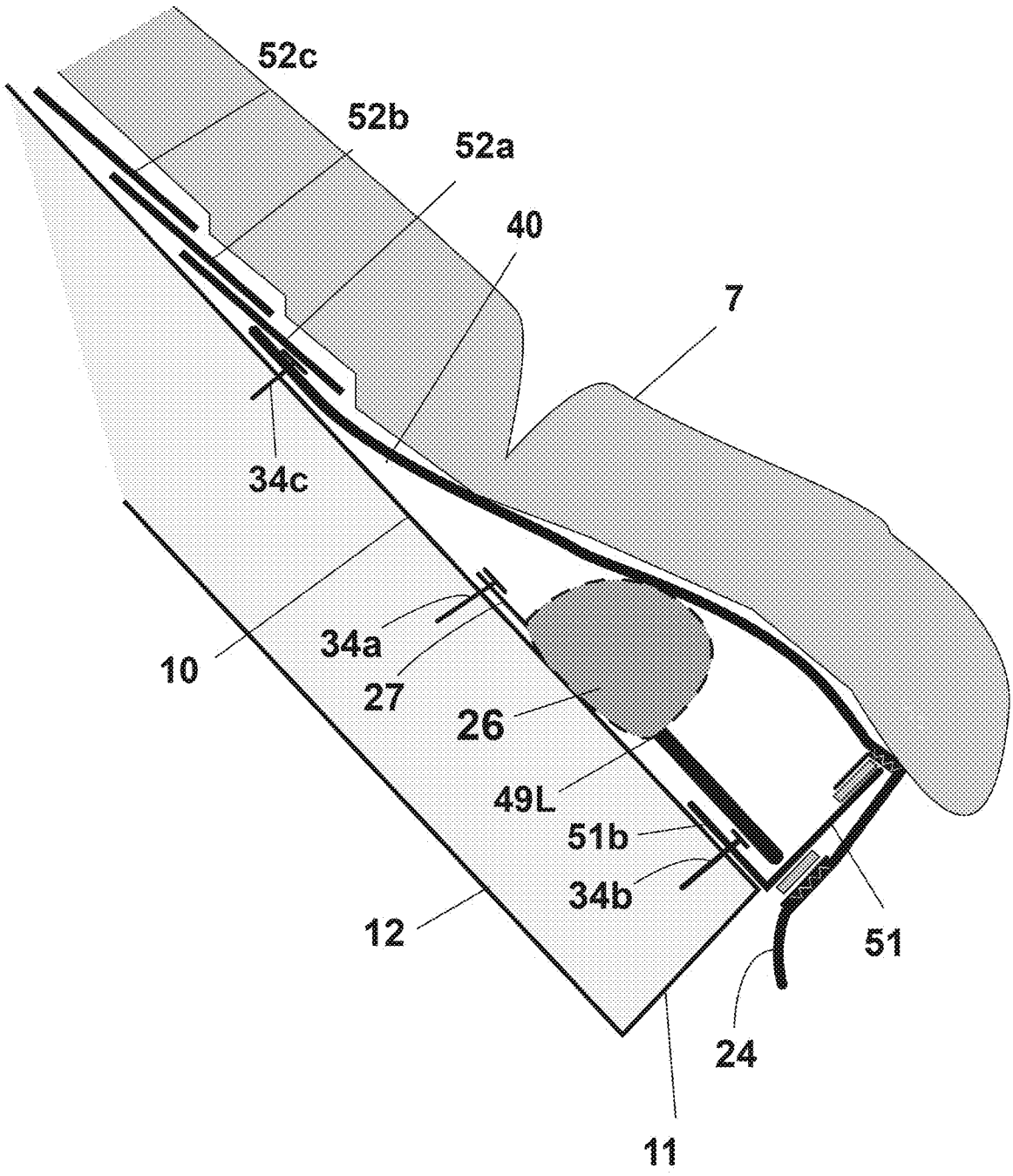
FIG. 5 is an end view of inflate membrane under gutter cover fully inflated which causes the snow pack on the roof to begin splitting into two sections as the weight and mass of the lower accumulation of snow begin to exit roof via gravity.
Figure 6:
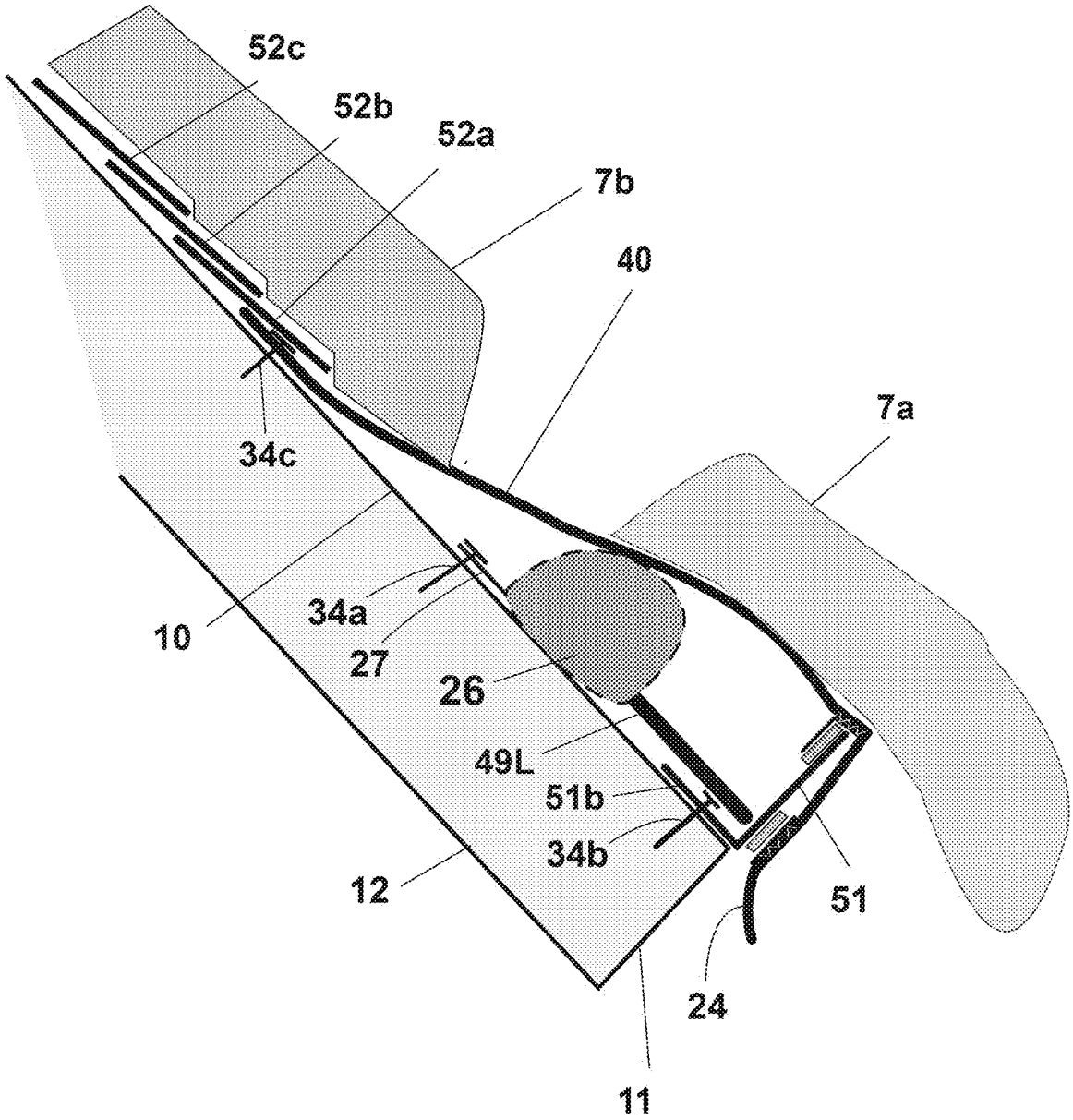
FIG. 6 is an end view of inflate membrane under gutter cover fully inflated which causes the snow pack to split into two section as the upper accumulation of snow is held on roof via the roof surface of the shingles. Lower snow pack is shown sliding off the roof via the slippery surface of gutter cover.
Figure 7:
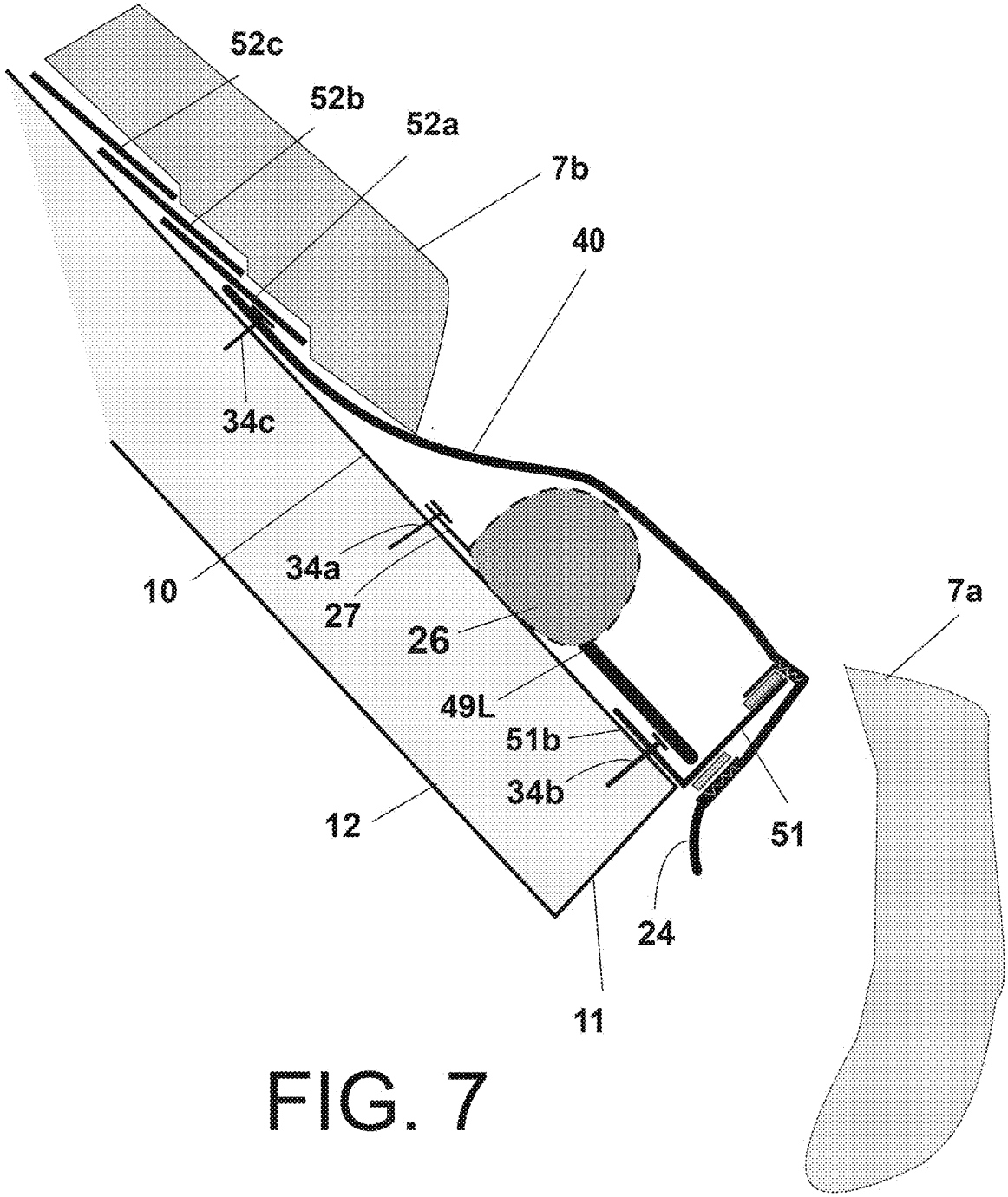
FIG. 7 is an end view of inflate membrane still inflated as lower snow pack of snow and ice falls off of the roof via gravity. Lower end of gutter cover functions as a drip edge should any water flow over the top of the gutter frame. Gutter cover completely covers and protects the lower roof and eave from water damage.

FIGS. 3, 4, 5, 6, 7 and 8 are sequential sides views of gutter cover 40 rising upward as inflate membrane 26 is inflated to remove snow 7 from roof 10 and moving downward as blower 21 (FIG. 10) is turned off. In FIG. 3, snow 7 has settled and is held on roof 10 on top of gutter cover 40 behind gutter frame 51 which acts as a brake so snow and ice can't slide or fall off roof 10 unexpectedly. Whether used in a residential or commercial setting, gutter frame 51 provides a high level of safety as well as liability protection from falling ice and snow for the building owner. In FIG. 4, as blower 21 is turned on, low pressure air with a flow rate of about 100 CFM and at a pressure between 1 to 4 PSI flows through blower line 49L into inflate membrane 26. As inflate membrane 26 expands upward as it is inflated, gutter cover 40 lifts upward, but is still held on roof via gutter frame 51 which acts as a brake. Inflate membrane 26 under gutter cover 40 is very powerful—at 2 PSI, which is less than the maximum air pressure output of blower 21, can lift as much as 282 pounds per square foot. This is enough upward force to lift and break up several inches of ice. In FIG. 5, inflate membrane 26 continues to inflate and expand under gutter cover 40 lifting snow 7 slightly higher than gutter frame 51 so that snow 7 can slide off roof 10. In FIG. 6, snow pack 7 is split into two parts, 7*a* and 7*b* as snow 7*b* continues to cling to the rough surface of shingles 52*c*, 52*b* and 52*a* as snow 7*a* slides above gutter frame 51 and off roof 11. In FIG.

Figure 8:
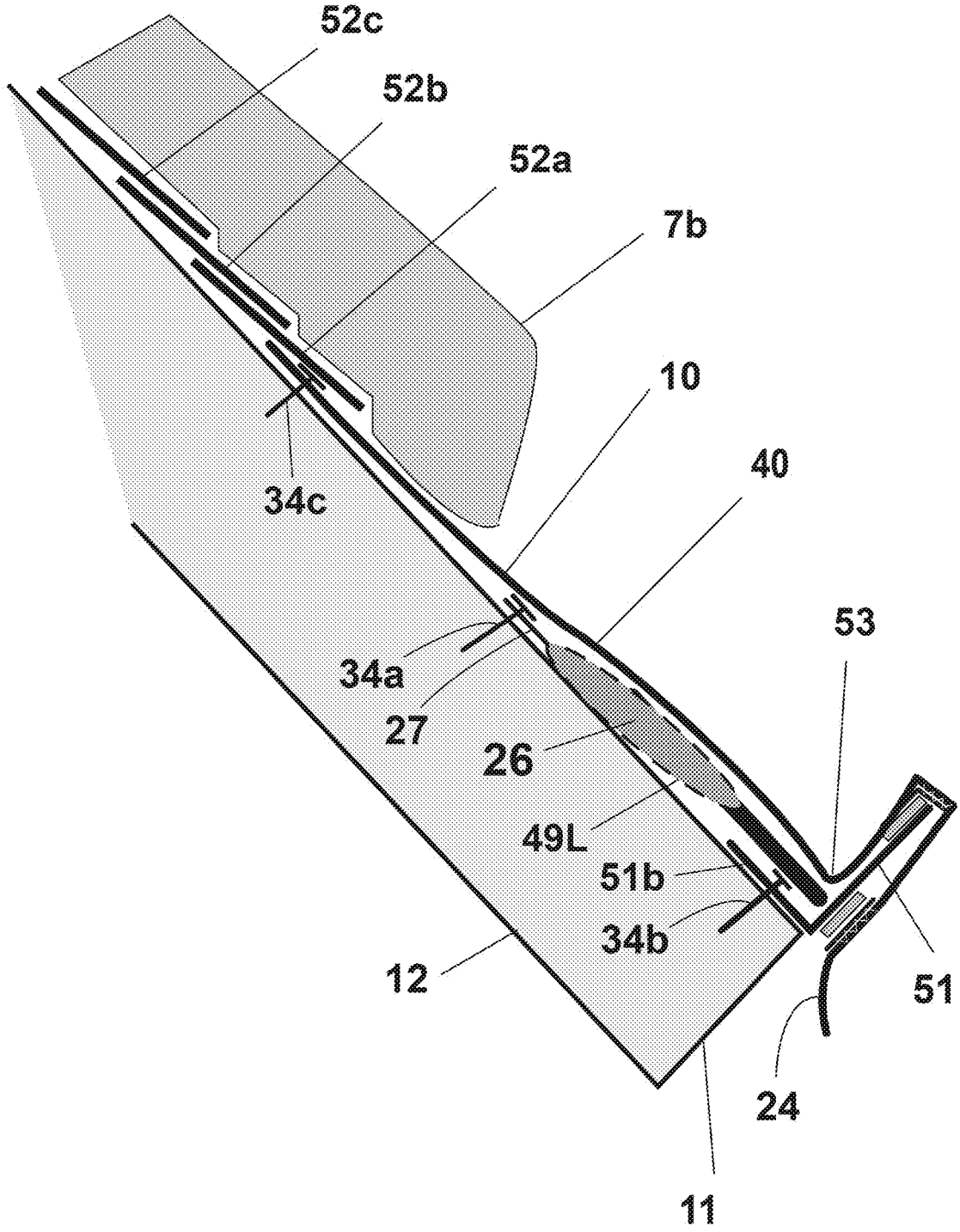
FIG. 8 is an end view of inflate membrane completely deflated allowing gutter cover to lower back down to the roof surface and the gutter trough to take shape again to catch runoff from the upper snow pack on roof.

7, snow 7*a* is removed from roof 10 as controlled by an operator to make sure the area below is clear and safe. For an added safety feature, blower 21 can be equipped with a sound alarm. In FIG. 8, blower 21 has been turned off allowing inflate membrane to deflate so gutter cover 40 can move downward and lay against roof 10. Notice that as snow 7*b* melts, drain water will be captured in gutter trough 53 and should snow 7*b* slide down roof, its downward motion will be stopped and held in place via gutter frame 51. The average width of gutter cover 40 from the top of gutter frame 51 to the top end where fastener 34*a* is applied is about 30" which is the typical area where ice dams typically form. Not only does gutter cover 40 remove ice, snow 7, leaves and other debris from roof 10, but it also protects the lower roof 10 and eave 11 from water leaks and water damage caused primarily by ice dams. Gutter cover 40 is also a water-proof barrier that protects your lower roof 10 and eave 11 from water damage.

Figure 9:
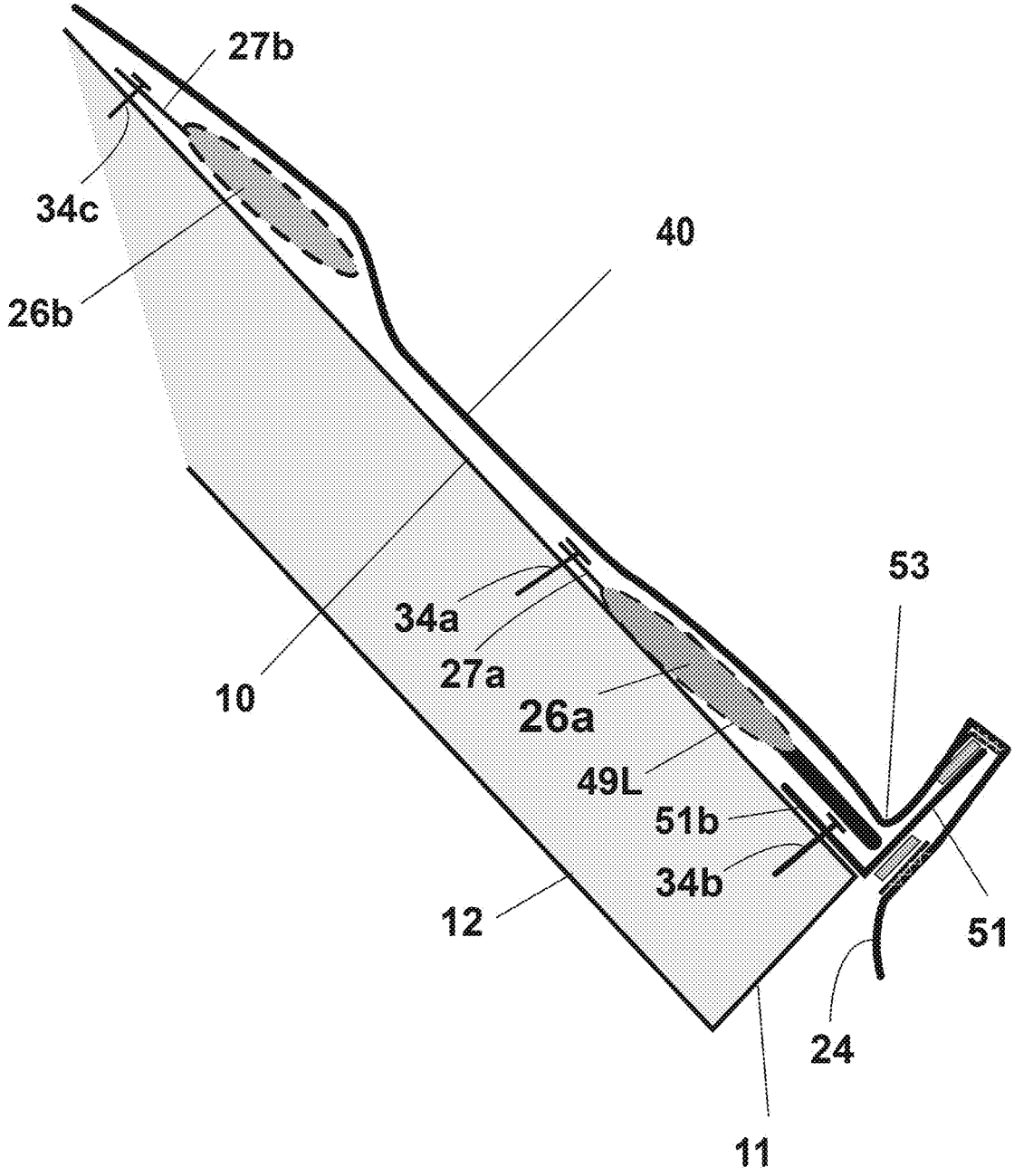
FIG. 9 is an end view of gutter cover extending further of the roof to the roof peak is desired with an additional inflate membrane above the lower one under gutter cover to cause movement to allow snow and ice to break free from the slippery top surface of the gutter cover.

FIG. 9 is an end view of gutter cover 40 extending more than the typical 30" up roof 10 from eave 11 of a building to provide greater coverage and protection from heavy snowfall that could cause excessive weight on roof 10 of a building and subsequent damage. In this configuration, added inflate membrane 26*b* is positioned further up roof 10 under gutter cover 40 to provide added movement and agitation so snow and ice can break free from the surface of gutter cover 40. If desired, gutter cover 40 and multiple inflate membranes (26) may be used on roof 10 from the eave 11 of roof 10 to the peak of roof 10. In this configuration, gutter cover 40 can remove snow 7 from the entire top surface of a section of roof 10.

Figure 10:
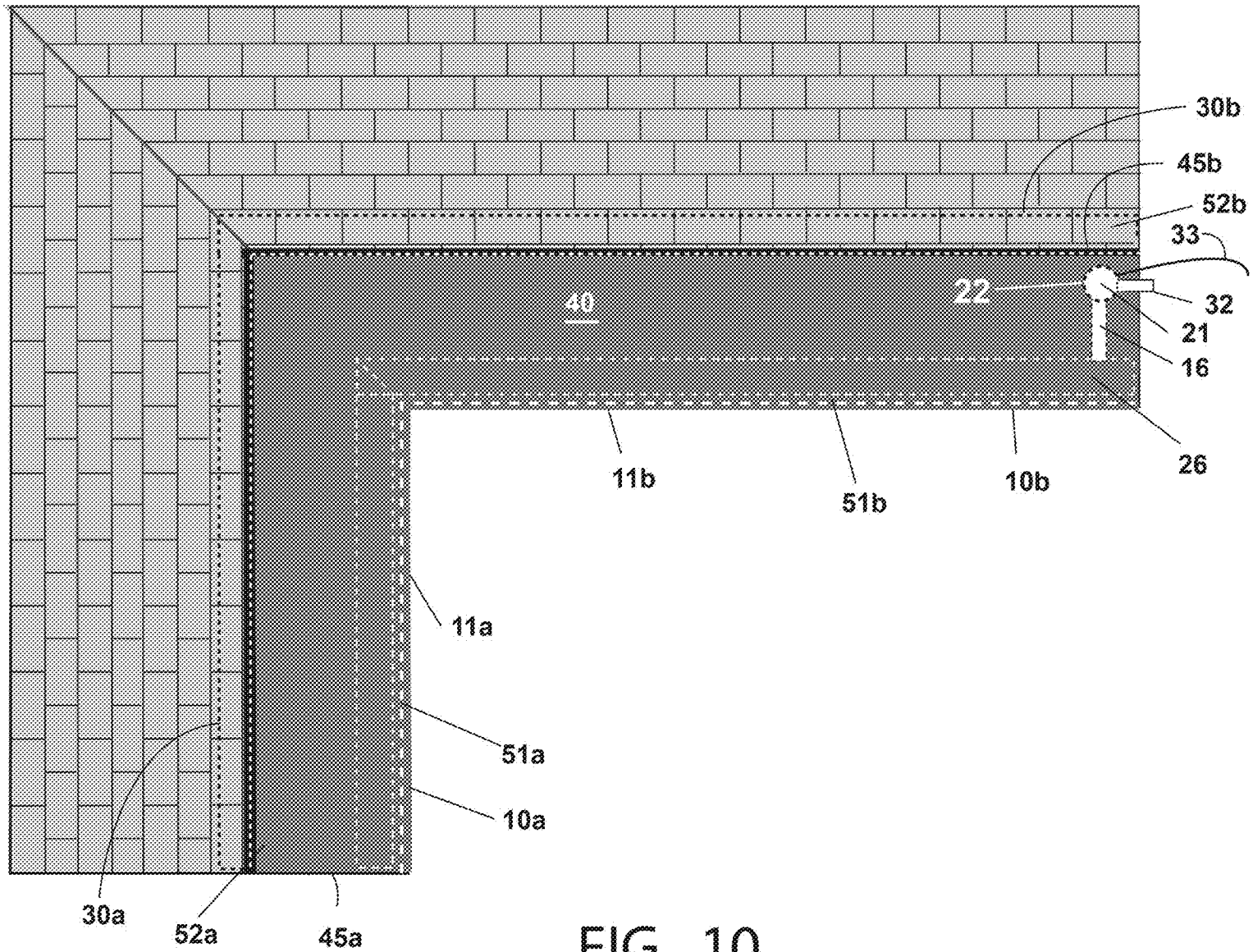
FIG. 10 is a top view of roof with gutter cover installed on the entire surface of the lower roof which includes over a roof valley and around an interior corner of the roof. Also show is blower, air lines and other controls installed under the gutter cover and connected to inflate membranes just above the eave of the roof.

FIG. 10 is a top view showing roof sections 10*a* and 10*b* with blower 21 and blower intake/exhaust 32 fastened to roof 10*b* as well as connected to inflate tube 16. Once blower 21 has been positioned properly and fastened to roof 10*b*, top of gutter cover 40 is attached and secured over blower 21. Also shown is the bottom 69 (FIG. 11) of edge gutter cover 40 extended over gutter frames 51*a* and 51*b* and attached to eaves 11*a* and 11*b*. A separate blower enclosure cover 22 is installed over blower 21 and the other blower components which may be made of the same fabric as gutter cover 40. Blower enclosure cover 22 is secured to gutter cover 40 in a permanent and leak proof manner. Also shown are inflate tube 16 connected to inflate membrane 26 as well as blower intake/exhaust assembly also located under gutter cover 40. Blower 21 can also be located in the attic of a building if desired. While it's possible to locate blower 21 on the roof 10 or fascia board 12, it may be unsightly and subject to the damaging effects of the weather.

Figure 11:
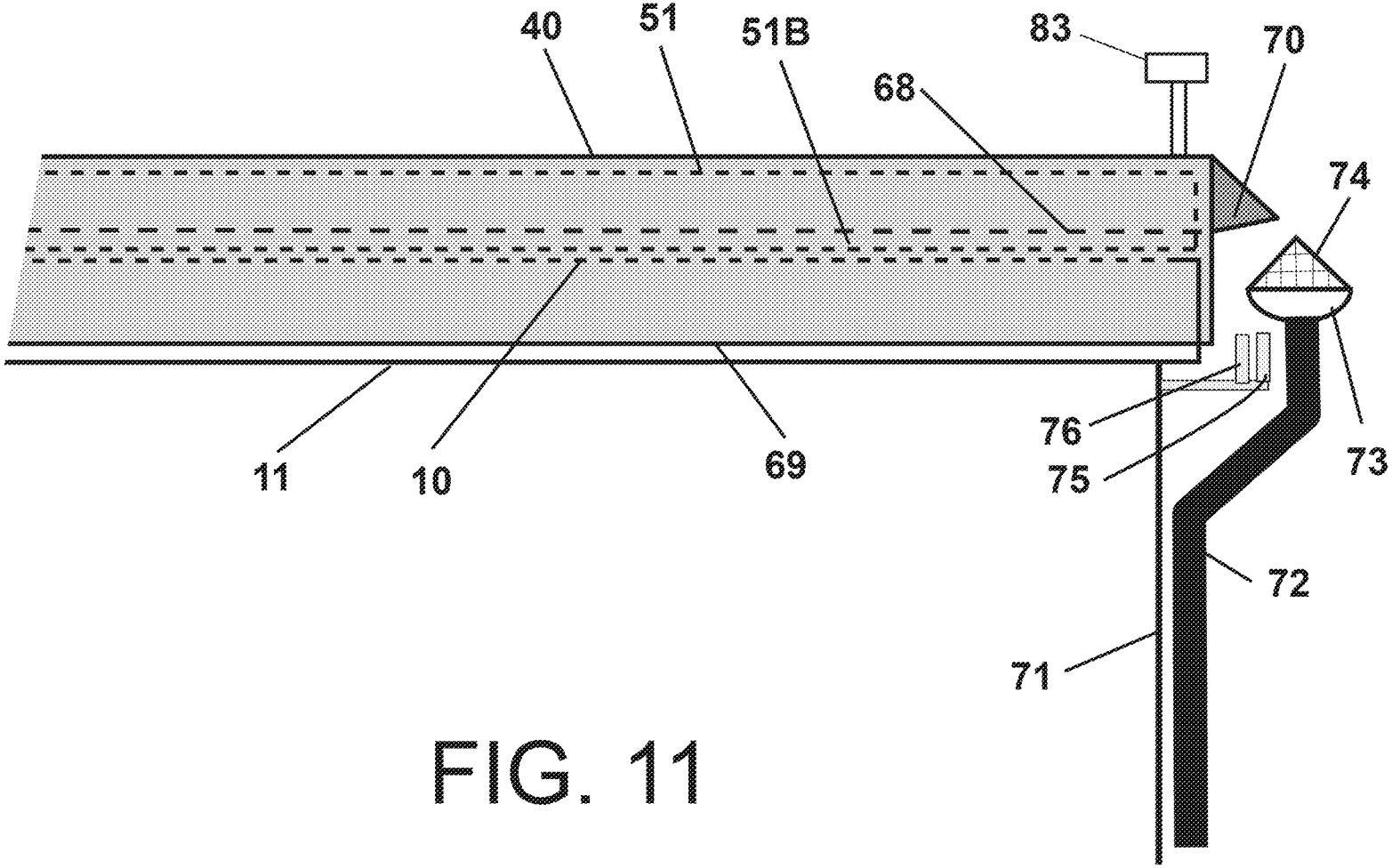
FIG. 11 is a front view of vertical gutter spout position next to gutter cover on a building's roof to receive water run off from the roof. Other controls are also mounted on the side of the building and on top of the roof.

FIG. 11 is a front view of roof 10 equipped with gutter frame 51 and gutter cover 40. To provide all season efficiency of gutter cover 40, building 71 is equipped with drain pipe 72 for proper drainage. During the warm months of the year, rain will fall on roof 10 and flow into cover trough bottom 68 and flow out of cover trough end 70 into collection bowl 73. Screen top 74 is used above collection bowl 73 to keep leaves and other debris out of drain pipe 72. Drain pipe 72, collection bowl 73 and screen top 74 may be equipped with heating elements such as heat cable or other heating devices to melt snow and ice between gutter cover 40 and drain pipe 72, specially before one operates inflatable tubes 16*a* and 16*b* to lift up gutter cover 40. To control these heating elements, temperature switch 76 is wired to an automatic electronic controller 28 (FIG. 15) to automatically turn the heat on and off as required. The controller 28 can be a programmable logic controller, microprocessor, computer, or other type of electronic controller known to those having ordinary skill in the art. To operate the self-cleaning feature of gutter cover 40 in the warmer months/climates during the year, rain sensor switch 75 may activate blower 21 to inflate gutter cover 40 via inflate tubes 16*a* and 16*b* so that rain water may flow over sloped gutter cover 40, gutter frame 51 and remove leaves, dirt and other debris. A timer in the controller may be set to an inflation cycle to the desired time sequence. Also shown is wind gauge switch 83 on roof 10 to activate the vacuum procedure (operated by an additional vacuum blower) under gutter cover 40 to hold it tight against the roof in case of high wind conditions. Gutter cover 40 should be manually operated during the winter to remove ice dams and icicles to monitor the procedure because of the falling ice and snow hazard. Prior to any operation, alarm 38 should be activated before blower turns on.

Figure 12:
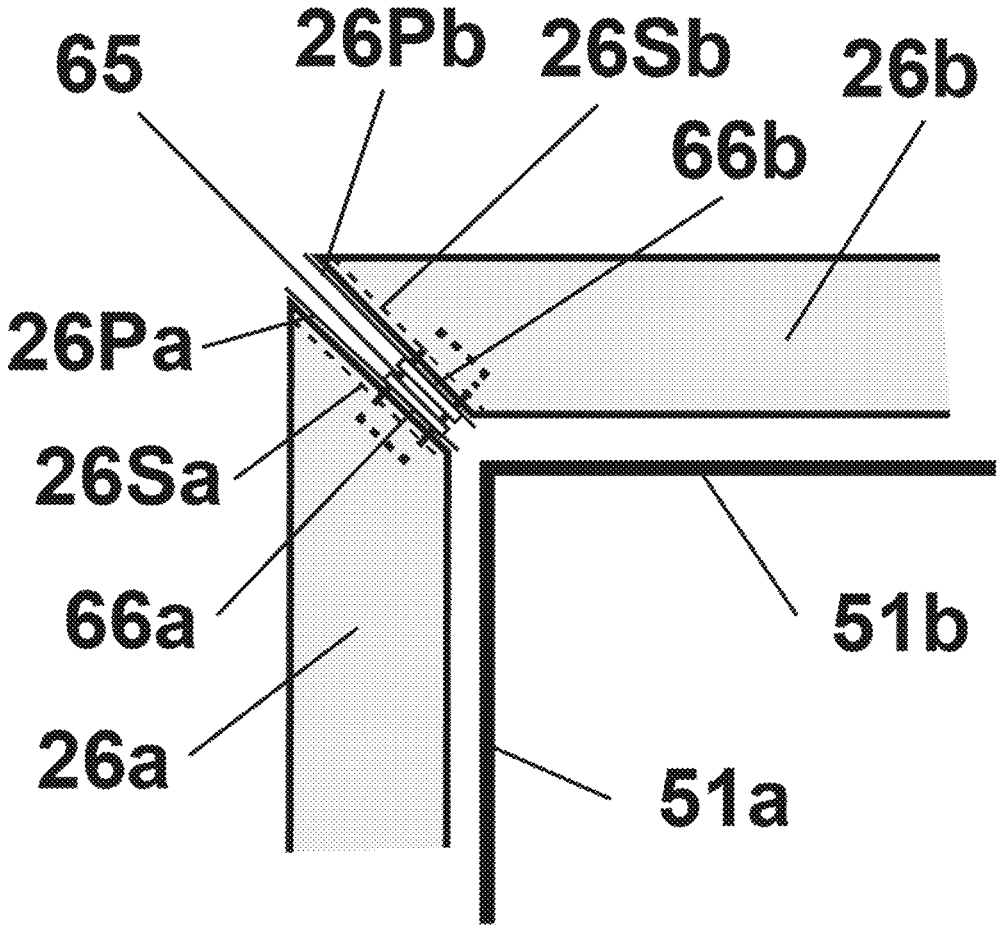
FIG. 12 is a top view of a corner section of a roof with inflate membranes connected via a hose fittings.

FIG. 12 is a top view of roof sections 10*a* and 10*b* forming an exterior corner of roof (10) where inflate membranes 26*a* and 26*b* are connected together via connector air tube 65 with air connector ports 66*a* and 66*b*. Ends of inflate membranes 26*a* and 26*b* are closed via stitches 26Pa and 26Pb and end stitches 26Sa and 26Sb respectively.

Figure 13:
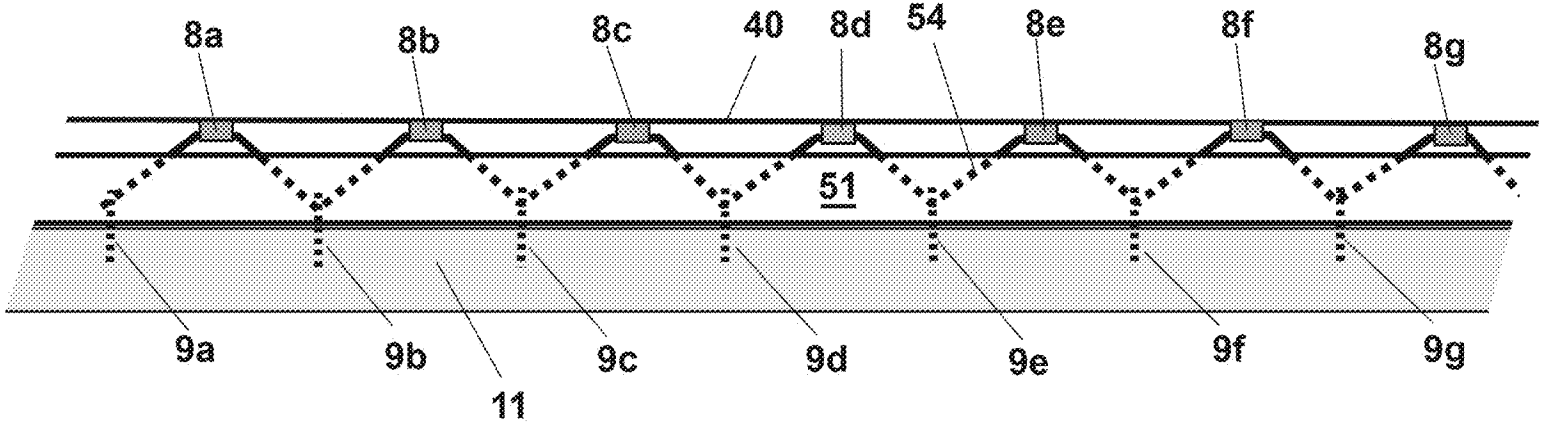
FIG. 13 is a front view of roof and eave of a building with a gutter frame and gutter cover installed. To help the gutter cover return properly inside the gutter trough after deflation, a length of bungee cord is attached between the underside of gutter cover and roof to apply a downward pull to gutter cover.

FIG. 13 is a cut-away, front view of gutter cover 40 equipped with cover loops 8*a* to 8*g* to hold and place downward tension on bungee cord 54 that is also held by eye screws 9*a* to 9*g* installed through holes in the base of gutter frame 51 and into roof 10. While it isn't always required, bungee cord 54 pulls gutter cover 40 back into position in gutter frame 51 after inflation.

Figure 14:
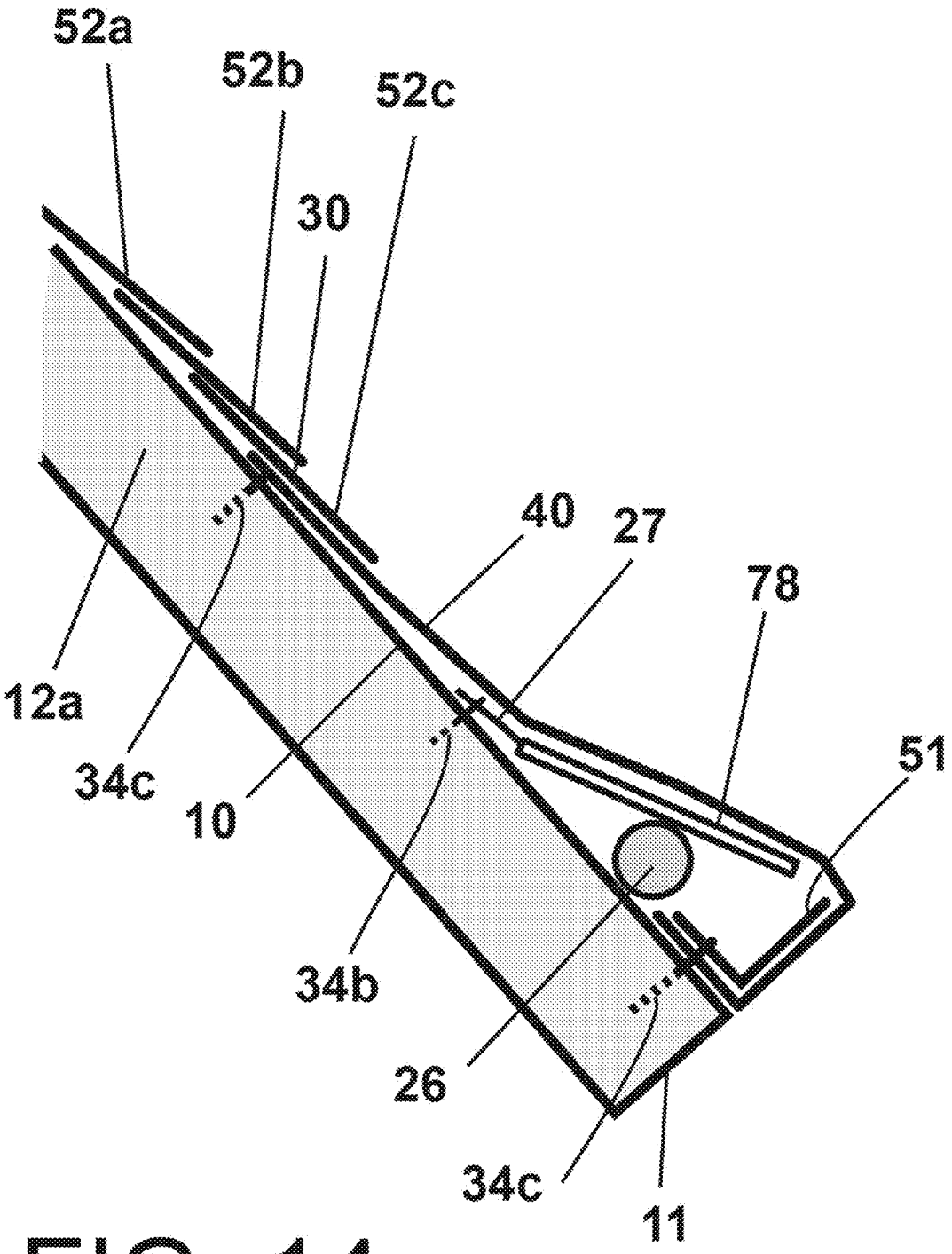
FIG. 14 is an end view of roof with gutter frame and gutter cover installed utilizing an inflate membrane placed between a hinge plate and gutter cover to provide a more precise lifting action of the gutter cover.

FIG. 14 is an end view of roof 10 equipped with gutter cover 40 that utilizes inflate membrane 26 positioned under lift plate 78 to provide a more precise lifting action. Lift plate 78 is equipped with inflate membrane flap 27, which acts as a hinge, attached to roof 10 via fastener 34*b*. Lift plate 78 can be made of semi-rigid material like stiff rubber sheet, plastic or fiberglass as well as a rigid material like metal or wood.

Figure 15:
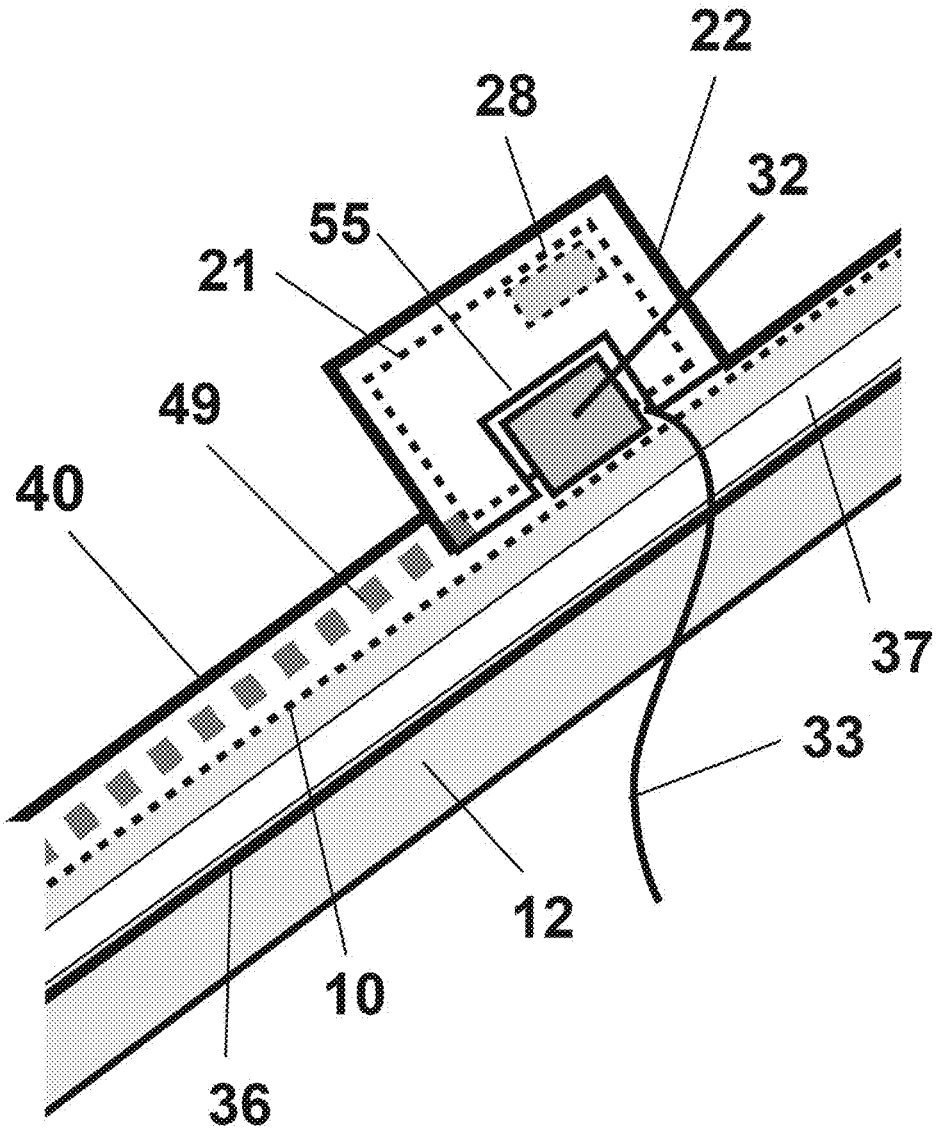
FIG. 15 is a side view of the blower components and control enclosure installed on roof under the gutter cover.

FIG. 15 is an end view of roof 10 with blower 21 and blower intake/exhaust 32 installed. As shown, blower enclosure cover 22 is installed on gutter cover 40 with waterproof seams to protect blower 21 and controller 28 from the weather and other hazardous conditions. Mounting blower 21 and other components such as controller 28 and blower outlet tube 49 under cover 40 not only eliminates the added costs and odd appearance of a rigid enclosure, clamps and air hose on a roof, but also provides easier hook-up and operation because the only external component is an electric cord 33. The edge of cover 40 extends over eave 11 and is fastened to eave 11 via clamp bar 37. Blower 21 can also be installed a build such as in an attic if desired.

Figure 16:
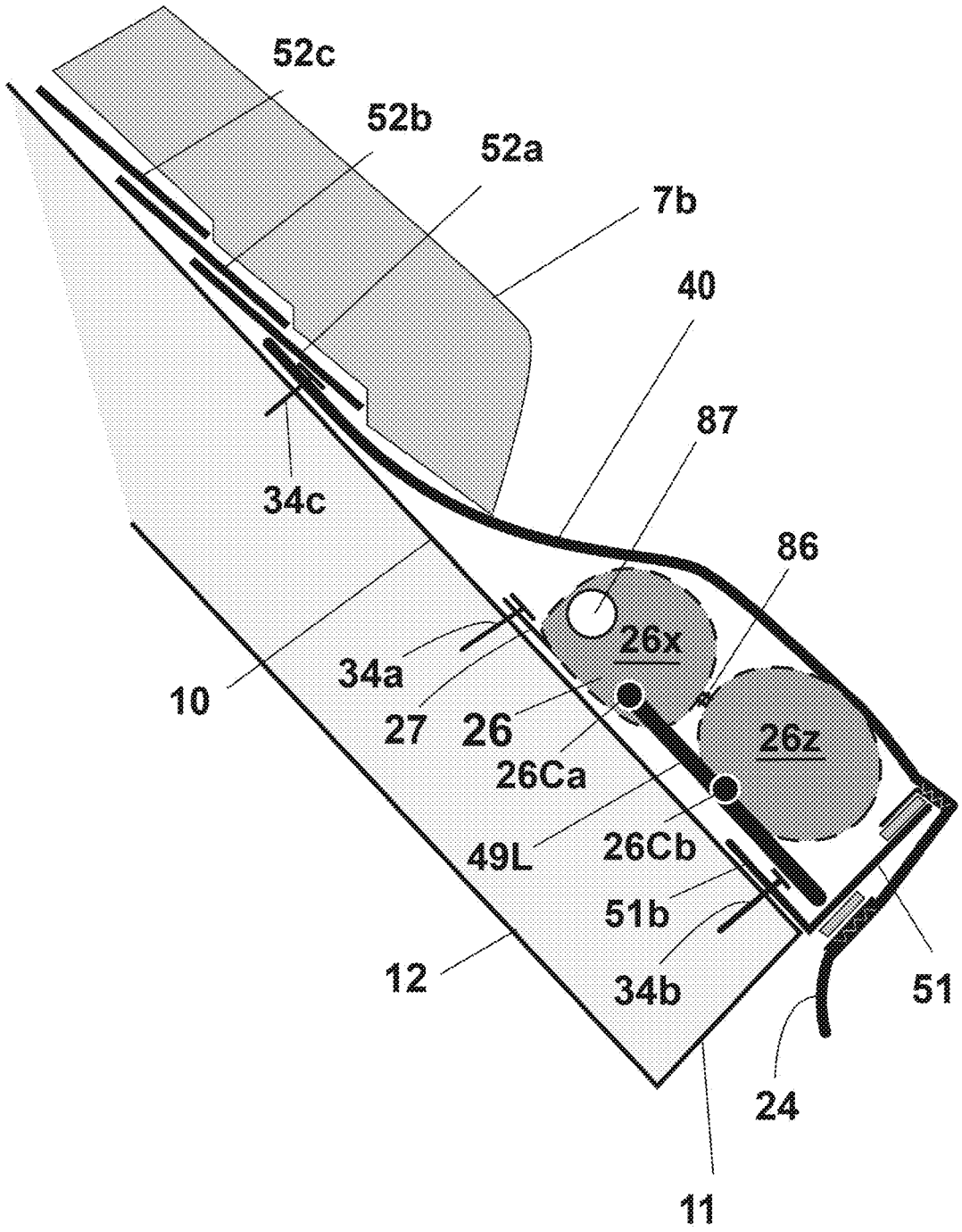
FIG. 16 is an end view of roof with a two compartment inflate membrane under gutter cover which can provide greater support under gutter cover especially for large roofs . . .

FIG. 16 is an end view of roof 10 with gutter frame 51 and gutter cover 40 installed which uses a single inflate membrane 26 that is divided into two compartments, 26*x* and 26*z* via stitch 86 to provide greater support under gutter cover 40. Notice that both inflate compartments 26*x* and 26*z* are equipped with an inflate tube coupler 26Ca and 26Cb from blower outlet tube 49L. This configuration may be used on a large commercial building having a large roof surface area requiring a larger than normal gutter assembly which could collect large amounts of ice. Also shown is pressure relief opening 87 that allows low pressure air to exit inflate membrane 26*x* when the air pressure builds too high, exceeding a predetermined threshold. For example, once the pressure inside inflate membrane 26 reaches a pressure that is high enough to remove a heavy ice and snow pack from roof 10 which might be 20" H2O, air is exhausted to prevent over pressurization of inflate membrane 26 which could cause damage to it. A high pressure electrical switch (such as a Dwyer #1910-20) can also be added to blower 21 which will turn off blower 21 when a certain high pressure setting (20" H2O) is reached.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

The invention claimed is:

1. A self-cleaning gutter system comprising:

an L-shaped gutter frame (51) comprising a gutter frame bottom (51*b*) thereby forming a gutter trough (53), the gutter frame bottom attachable parallel to a plane of an eave (11) at a lowest end of a roof (10);

an inflatable inflate membrane (26);

an inflate membrane flap (27) attachable at a first end to the roof (10) uphill from the gutter frame (51) and attached at a second end to the inflate membrane (26), thereby securing the inflate membrane uphill from the gutter frame; and a flexible gutter cover (40) sized to be attached under a shingle (52*a*) uphill from the inflate membrane flap (27), cover the inflate membrane (26) in both a deflated state and an inflated state, and cover the gutter frame, whereby the inflate membrane (26) in the deflated state causes gutter contents (7) to be selectively retained on the roof by the gutter frame (51) in the gutter trough (53), and the inflate membrane (26) in the inflated state causes the gutter contents to be lifted upward and over an upper edge of the gutter frame (51) and out of the gutter trough (53), thereby selectively removing the gutter contents from the roof (10).

2. The self-cleaning gutter system of claim 1, further comprising fasteners for securing the gutter cover to the gutter frame.

3. The self-cleaning gutter system of claim 2, the fasteners comprising hook fasteners (84) and loop fasteners (85), staples, nails, or screws.

4. The self-cleaning gutter system of claim 1, wherein a lower end of the gutter cover (40) terminates in a drip edge (24) for keeping water, snow, and ice from the eave (11).

5. The self-cleaning gutter system of claim 1, further comprising a blower (21) pneumatically connected to the inflate membrane (26).

6. The self-cleaning gutter system of claim 5, further comprising a blower line (49L) or inflate tube (16) pneumatically connecting the inflate membrane (26) and the blower (21).

7. The self-cleaning gutter system of claim 5, further comprising an automatic electronic controller (28) in electrical communication with the blower (21) configured for controlling operation of the blower.

8. The self-cleaning gutter system of claim 7, the controller (28) comprising at least one of a programmable logic controller, microprocessor, or computer.

9. The self-cleaning gutter system of claim 7, further comprising at least one of a rain sensor switch (75), a temperature switch (76), and a wind gauge switch (83) in communication with the controller (28).

10. The self-cleaning gutter system of claim 7, further comprising a heater attached to a building (71) drain pipe (72), collection bowl (73) and/or screen top (74), the heater in communication with the controller (28) and configured to melt snow and ice between the gutter cover (40) and the drain pipe (72).

11. The self-cleaning gutter system of claim 7, further comprising a blower enclosure cover (22) installed on the gutter cover with waterproof seams to protect the blower (21) and controller (28) from weather and hazardous conditions.

12. The self-cleaning gutter system of claim 7, further comprising a blower intake/exhaust (32) and an electric cord (33) attached to the blower (21).

13. The self-cleaning gutter system of claim 1, the inflate membrane (26) comprising a first inflate membrane (26*a*) and a second inflate membrane (26*b*) secured further up the roof (10) than the first inflate membrane, each inflate membrane disposed under the gutter cover (40) for providing additional movement and agitation so snow and ice can break free from a surface of the gutter cover.

14. The self-cleaning gutter system of claim 1, the inflate membrane (26) comprising a first and second inflate membrane compartment (26*x*, 26*z*) separated by a stitch (86);

an inflate tube coupler (26Ca, 26Cb) attached to a respective inflate membrane compartment at a first and attached to a blower outlet tube (49L) at a second end.

15. The self-cleaning gutter system of claim 1, further comprising a pressure relief opening (87) configured to allow air to exit the first inflate membrane compartment (26*x*) when air pressure exceeds a predetermined threshold.

16. The self-cleaning gutter system of claim 1, further comprising a lift plate (78) disposed between the inflate membrane (26) and the gutter cover (40), the lift plate comprising an inflate member flap (27) attached to the lift plate at a first end of the inflate member flap and the roof (10) at a second end of the inflate member flap, the inflate member flap configured to operate as a hinge.

17. The self-cleaning gutter system of claim 1, further comprising:

cover loops (8*a*-8*g*) attached to an edge of the gutter cover (40);

eye screws (9*a*-9*g*) attached to the gutter frame (51); and a bungee cord (54) threaded through the cover loops and eye screws, configured to retain the gutter cover.

18. The self-cleaning gutter system of claim 1, the inflate membrane (26) comprising:

a first inflate membrane (26*a*); and a second inflate membrane (26*b*) secured perpendicular to the first inflate membrane;

the system further comprising a connector air tube (65) pneumatically connecting the first inflate membrane and second inflate membrane.

19. The self-cleaning gutter system of claim 1, the gutter cover (40) made of a PVC-coated, woven polyester fabric having fabric weights between 20 and 40 ounces.

20. The self-cleaning gutter system of claim 1, the gutter cover (40) being white or silver in color to reflect sunlight and keep an interior of a building cooler.

* * * * *